United States Patent [19]

Kaine, Jr. et al.

[11] 4,308,851

[45] Jan. 5, 1982

[54] BOWSTRING DRAW AND TRIGGER RELEASE APPARATUS

[76] Inventors: Albert A. Kaine, Jr., 9818 Cedar, Overland Park, Kans. 66207; David L. Mabry, 8612 E. 9th St., Kansas City, Mo. 64125

[21] Appl. No.: 87,222

[22] Filed: Oct. 22, 1979

[51] Int. Cl.[3] ..... F41B 5/00

[52] U.S. Cl. ..... 124/35 A

[58] Field of Search ..... 124/35 A, 23 R, 24 A, 124/24 R, 41 A

[56] References Cited

U.S. PATENT DOCUMENTS

| | | | |
|---|---|---|---|
| 3,821,945 | 7/1974 | Foster | 124/36 X |
| 3,845,752 | 11/1974 | Barner . | |
| 3,916,868 | 11/1975 | Wolfe . | |
| 3,952,720 | 4/1976 | Wilson . | |
| 3,954,095 | 5/1976 | Lewis . | |
| 3,998,202 | 12/1976 | Boyko . | |
| 4,009,703 | 3/1977 | Cunningham | 124/35 A |
| 4,022,181 | 5/1977 | Fletcher . | |
| 4,062,339 | 12/1977 | Wilson . | |
| 4,066,060 | 1/1978 | Napier | 124/35 A |

*Primary Examiner*—Richard J. Apley
*Assistant Examiner*—William R. Browne
*Attorney, Agent, or Firm*—Lowe, Kokjer, Kircher, Wharton & Bowman

[57] ABSTRACT

A device for use in drawing the bowstring of an archery bow and triggering release of the bowstring. A hollow body which fits in the hand carries a pivotal holding member which is held by a pivotal linkage bar in a cocked position wherein the bowstring can be drawn. A cord is passed around the bowstring and looped over the holding member. A roller bearing is carried on the holding member to reduce the friction, wear and finger pressure required to release the bowstring and to provide a smooth release. A trigger arm pivots the linkage bar to release it from the roller bearing, thus releasing the bowstring.

6 Claims, 3 Drawing Figures

BOWSTRING DRAW AND TRIGGER RELEASE APPARATUS

BACKGROUND AND BRIEF DESCRIPTION OF THE INVENTION

This invention relates in general to an improved bowstring draw and trigger release mechanism. The bowstring draw and trigger release mechanism of the present invention is operable to firmly hold a bowstring as it is being drawn away from the bow and to smoothly release the string in response to activation of the device's trigger arm.

Several different types of bowstring draw and trigger release mechanisms are well known in the prior art. These prior art mechanisms are typically provided with a holding member which is capable of pivoting between a cocked position and a fired position. This holding member is used to secure the bowstring to the device either directly or by means of a flexible loop which is capable of being looped about the bowstring and holding member. In either case, the holding member serves to secure the bowstring to the device when it is in the cocked position and to release the bowstring when it is in the fired position. Movement of the holding member is controlled by means of a trigger arm which is pivotally mounted onto the device.

In the prior art, the trigger arm is coupled with the holding member in one of several ways. The most common type of coupling between the trigger arm and holding member comprises a physical engagement between these two elements. A projection on the trigger arm contacts the holding member to prevent the holding member from rotating from its cocked position to its fired position under the force of the tensioned bowstring. Pivotal movement of the trigger arm, however, causes the projection of the arm to release the holding member thereby allowing the holding member to move from the cocked position to the fired position. This movement of the holding member in turn releases the bowstring thereby causing the arrow to be projected toward the desired target.

A second type of coupling between the trigger arm and holding member comprises a physical linkage between these two elements by means of a coupling member. This coupling member is attached to the trigger arm and holding member to cause these components of the device to move in unison with each other. The trigger arm is arranged to be movable between a normal position wherein the holding member is maintained in the cocked position and a pivoted position wherein the holding member is moved to the fired position. In this arrangement, movement of the trigger arm from its normal position to its pivoted position by the user of the device causes the holding member to be moved from its cocked position to its fired position thereby initiating the release of a bowstring held by the device.

None of these prior art bowstring draw and trigger release mechanisms however have proved to be totally satisfactory. Most of the known prior art devices require the application of a significant amount of force to the device's trigger arm in order to effectuate release of a bowstring held by the device. In addition, the basic design of these devices may prevent a smooth release of a bowstring held by the device. An additional problem area associated with the devices which utilize a physical engagement between the trigger arm and holding member is that the sliding contact between these elements of the device causes them to become worn through normal use. The resultant effect of this wear is the inoperability of the device.

It is therefore an object of the present invention to provide an improved bowstring draw and trigger release mechanism which is operable to provide a smooth release of a bowstring in response to activation of the device's trigger arm.

Another object of the present invention is to provide an improved bowstring draw and trigger release mechanism having a holding member for temporarily securing the bowstring to the device and a trigger arm for controlling the position of the holding member by means of a linkage bar which is pivotally mounted to the device and a roller bearing which is carried by the holding member.

An additional object of the present invention is to provide a bowstring draw and trigger release mechanism of the character described which is operable to release the bowstring in response to only a slight amount of finger pressure applied to the trigger arm by the user of the device.

It is another object of the present invention to provide a bowstring draw and trigger release mechanism of the character described which is simple and inexpensive to manufacture and easy to use.

Other and further objects of the invention, together with the features of novelty appurtenant thereto will appear in the course of the following description.

DETAILED DESCRIPTION OF THE INVENTION

In the accompanying drawings which form a part of the specification and are to be read in conjunction therewith and in which like reference numerals are employed to indicate like parts in the various views.

Figure 1:
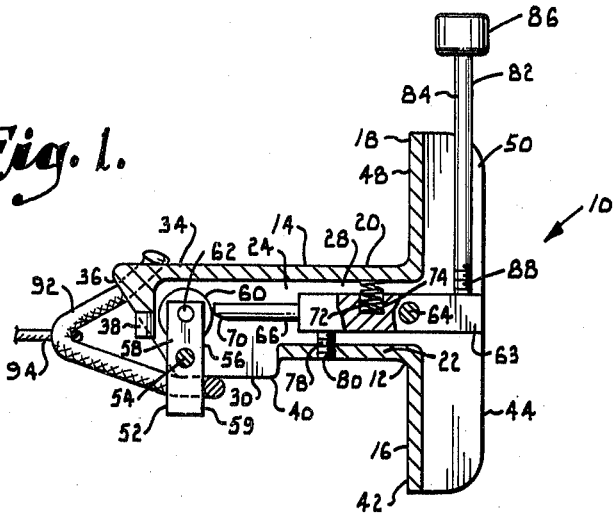
FIG. 1 is a side sectional view of a bowstring draw and trigger release mechanism which is constructed according to a preferred embodiment of the present invention with a bowstring being held by the device.

Reference is now made to the drawings in detail wherein the numeral 10 is used to designate a bowstring draw and trigger release mechanism which is constructed in accordance with a preferred embodiment of the present invention. The movable components of the device are contained within a T-shaped outer housing 12 which is comprised of a body portion 14 and a pair of extending arm portions 16 and 18. The body portion 14 of housing 12 is constructed to have a square cross sectional configuration and is formed by a top wall 20, a bottom wall 22 and a pair of side walls 24 and 26. Body portion 14 is constructed to have a hollow inner cavity 28. Side walls 24 and 26 extend past the body portion 14 of housing 12 to provide a pair of flanges 30 and 32. Flanges 30 and 32 are coupled with each other by means of an extension 34 of top wall 20. This extension terminates an in-turned end portion 36. A rubber stop 38 is attached to the in-turned end portion 30 of extension 28. In this way, the flanges 30 and 32 and extension 34 cooperate to provide at the terminating end of the body portion 14 of housing 12 a three-sided structure having an opening 40 adjacent to the bottom wall 22 of housing 12.

The extending arm portions 16 and 18 of housing 12 extend outward from the body portion 14 of the housing in opposite directions to provide a gripping handle about which the fingers of the user of the device may be wrapped. Extending portion 16 is integrally formed with body portion 14 and is comprised of a front wall 42 and a pair of outwardly projecting side walls 44 and 46. Side walls 44 and 46 form a right angle with front wall 42 and extend outward from the front wall in a parallel arrangement to form a U-shaped structure. Extending portion 18 is similarly constructed to have a front wall 48 and a pair of outwardly extending side walls (only one of these side walls shown herein and is designed by the numeral 50).

Figure 3:
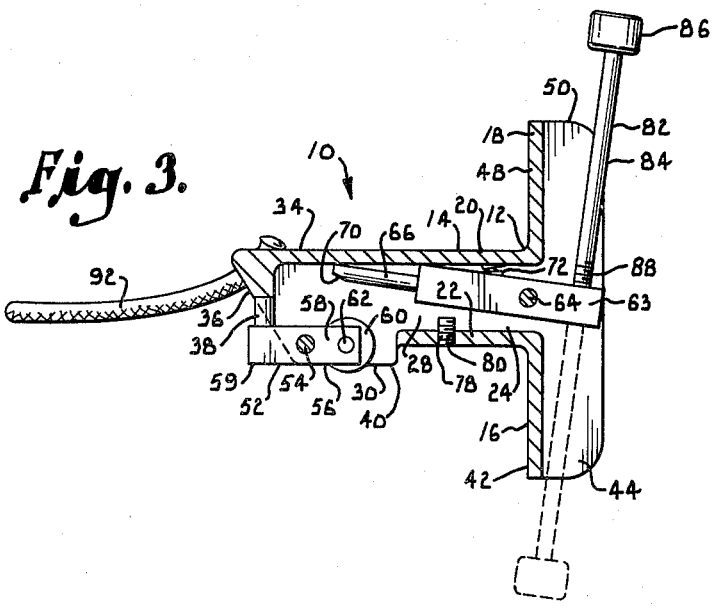
FIG. 3 is a side sectional view of the bowstring draw and trigger release mechanism of the present invention following release of the bowstring.

A holding member 52 is disposed between flanges 30 and 32 and is rotatably coupled to the flanges by means of a pivot pin 54 such that it is capable of pivoting between a cocked position which is shown in FIG. 1 and a fired position which is shown in FIG. 3. Holding member 52 is coupled with flanges 30 and 32 such that a portion of the holding member extends outward from the coupling point in opposite directions. In particular, a portion of holding member 52 extends into the housing from the coupling point. This portion of holding member is hereinafter referred to as the inwardly extending portion of the holding member and is designated by the numeral 56. The inwardly extending portion 56 of holding member 52 is slotted to provide a pair of oppositely positioned flanges such as 58 and has a roller bearing 60 rotatably mounted between these flanges by means of a coupling pin 62. The oppositely extending portion of holding member 52 is referred to as the outwardly extending portion of the holding member and is designated by the numeral 59. The outwardly extending portion 59 of holding member 52 is sufficiently long to extend outward through opening 40 beyond the outer edges of flanges 30 and 32.

A linkage bar 63 is pivotally mounted within cavity 28 of housing 12 by means of a pivot pin 64 such that the linkage bar is capable of moving between a hold position which is shown in FIG. 1 and a release position which is shown in FIG. 3. Linkage bar 63 has a locking arm 66 mounted to one end thereof. Locking arm 66 extends outward from linkage bar 63 such that it is capable of engaging the outer surface of roller bearing 60 whenever holding member 52 is in its cocked position and the linkage bar is in its hold position as shown in FIG. 1. The outer end of locking arm 66 is beveled at 70.

A compression spring 72 is mounted within a cylindrically shaped opening 74 in linkage bar 63. Compression spring 72 bears against top wall 20 to bias linkage bar 63 in the hold position shown in FIG. 1. A set screw 78 which is threaded into an aperature 80 is used to adjustably control counterclockwise rotation of linkage bar 63 to adjust the hold position of the linkage bar.

A trigger arm 82 is threadably mounted onto the end of linkage bar 63. Trigger arm 82 is comprised of an elongated pin 84 having an enlarged head portion 86 and a threaded end portion 88. The threaded end portion 88 of trigger arm 82 is threadably received by a threaded aperature 90 in linkage bar 63 to thereby removably mount the trigger arm to the linkage bar. When the trigger arm is mounted in the position shown in solid lines in FIGS. 1 and 3, it serves to move the pivot bar from the hold position shown in FIG. 1 to the release position shown in FIG. 3 whenever the trigger arm is moved away from end wall 48. Movement of the trigger arm in this manner is preferably performed by the third finger of the user's hand. When the trigger arm is mounted to the linkage bar as shown in FIG. 3 in broken lines, the trigger arm serves to move linkage bar 63 from the hold position shown in FIG. 1 to the release position shown in FIG. 3 whenever the trigger arm in this manner is preferably moved by the thumb of the user's hand.

A flexible draw cord 92 has each of its opposing ends suitably attached to extension 34 to form a continuous loop. Draw cord 92 is mounted to extension 34 by passing each end of the cord through a corresponding aperature in the extension. The draw cord is in turn secured within the aperature by providing a knot or other fixing means at each end of the draw cord to prevent it from being withdrawn through its corresponding aperture. The draw cord 92 is typically comprised of a strong flexible cord and may be made of nylon, or some other suitable material.

To use this bowstring and draw and trigger release mechanism, holding member 52 is initially placed in the cocked position shown in FIG. 1. When the holding member is in this position, locking arm 66 engages the outer surface of roller bearing 60 to prevent the holding member from pivoting to the fired position shown in FIG. 3.

Figure 2:
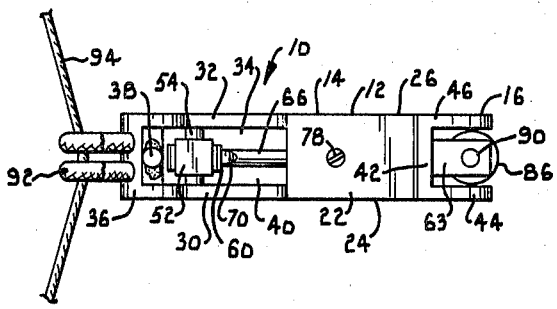
FIG. 2 is a bottom plan view of the bowstring draw and trigger release mechanism shown in FIG. 1.

Draw cord 92 is then looped around a bowstring 94 and over the outward extending portion 58 of holding member 52 as shown in FIGS. 1 and 2. The user of the device then wraps his fingers around the extending arm portions 16 and 18 of the housing 12 such that the body portion 14 of the housing rests between two of the user's adjacent fingers. The user of the device then draws the device away from the bow on which the bowstring is attached. The notch of the arrow to be projected by the bow is preferably positioned on the bowstring just above the central portion of the loop.

The bowstring draw and trigger release mechanism of the present invention is operable to hold the bowstring in a taunt or tensional relationship relative to the bow until trigger arm 82 is either moved away from front wall 48 or toward front wall 42 depending upon the manner in which the trigger arm is mounted to linkage bar 63. If the trigger arm is mounted to the linkage bar 63 as shown in solid lines in FIG. 3, movement of the trigger arm 82 away from front wall 48 of the extending arm portion 18 causes the linkage bar to move from the hold position shown in FIG. 1 to the release position shown in FIG. 3. Similarly, movement of the trigger arm toward front wall 42 of extending arm portion 16 causes linkage bar 63 to move from the hold position shown in FIG. 1 to the release position shown in FIG. 3 if the trigger arm is mounted to a linkage bar as shown in broken lines in FIG. 3. Movement of linkage bar 63 into the release position shown in FIG. 3 causes locking arm 66 to become disengaged from the outer surface of roller bearing 60 thereby allowing holding member 52 to move to the fired position shown in FIG. 3 in response to the force applied to draw cord 92 and holding member 52 of the bowstring. Roller bearing 60 serves to reduce the frictional interaction between locking arm 66 and holding member 52 in response to movement of linkage bar 63 to the release position shown in FIG. 3. Smoother interaction between the locking arm 66 and roller bearing 60 is further achieved by beveling the outer edge of the locking arm as shown at 70.

As holding member 52 rotates from the cocked position shown in FIG. 1 to the fired position shown in FIG. 3, draw cord 92 slips from the holding member thereby causing the bowstring to be released. Upon release of the bowstring, the arrow is projected toward its designated target by the forward movement of the string.

From the foregoing it will be seen that this invention is one well adapted to obtain all of the ends and objects herein above set forth together with other advantages which are obvious and which are inherent to the structure.

It will be understood that certain features and subcombinations are of utility and may be employed without reference to other features and subcombinations.

As many possible embodiments have been made of the invention without departing from the scope thereof, it is to be understood that all matter herein set forth are shown in the accompanying drawings and are to be interpreted as illustrative and not in a limiting sense.

Having thus described our invention, we claim:

1. A bowstring draw and trigger release mechanism comprising:

a body adapted to be held in the hand;

a holding member mounted on said body for pivotal movement between first and second positions for holding and releasing a bowstring, respectively, said holding member having opposite ends which move through an arc of substantially 90° between the first and second positions;

a linkage member having a generally flat end;

a roller mounted for rotation on one end of said holding member and carried therewith through said 90° arc between the first and second positions, the opposite end of said holding member projecting out of said body;

means for mounting said linkage member on said body for pivotal movement between a hold position wherein said flat end of the linkage member engages said roller in a manner to retain said holding member in the first position thereof, and a release position wherein said flat end of the linkage member is disengaged from the roller to permit movement of said holding member to the second position thereof for release of the bowstring; and yieldable means for biasing said linkage member toward the hold position thereof.

2. A mechanism as set forth in claim 1, including a beveled surface on said linkage member adjacent said flat end thereof to facilitate release of said linkage member from said roller.

3. A mechanism as set forth in claim 1, including an adjustment screw threaded into said body and engaging said linkage member in a manner to provide for adjustment of the hold position of the linkage member in response to threaded adjustment of said screw.

4. A device for drawing and releasing a bowstring, said device comprising:

a body adapted to be held in the hand;

a substantially straight holding member mounted on said body for movement about a pivot axis between first and second positions for respectively holding and releasing the bowstring, said holding member having a holding portion extending outwardly of the body from said pivot axis and having an opposite end portion which moves through an arc of substantially 90° between the first and second positions;

a roller mounted for rotation on said opposite end portion of the holding member and carried therewith through said 90° arc between the first and second positions;

a cord adopted to be drawn around the bowstring and looped around said holding portion of the holding member when same is in the first position;

a generally straight linkage member pivotally mounted on said body for movement between a hold position wherein said linkage member engages said roller to retain the holding member in its first position and a release position wherein the linkage member releases from said roller to permit movement of the holding member to its second position for release of the bowstring, said linkage member being oriented substantially perpendicular to said holding member in the holding position;

yieldably means for urging said linkage member toward the holding position; and finger operated trigger means for effecting movement of said linkage member from the holding position to the release position.

5. A device as set forth in claim 4, wherein said trigger means comprises a trigger arm extending from and generally normal to said linkage member.

6. A device as set forth in claim 4, including an adjustment screw threaded into said body and engaging said linkage member in a manner to effect adjustment of the hold position of the linkage member in response to threaded adjustment of the screw.

* * * * *